US006834410B2

(12) United States Patent
Phillipson et al.

(10) Patent No.: US 6,834,410 B2
(45) Date of Patent: Dec. 28, 2004

(54) DEVICE AND METHOD OF ASSEMBLING A SUBMERSIBLE POOL CLEANER

(75) Inventors: Brian H. Phillipson, Longwood, FL (US); Paul Sebor, Heathrow, FL (US)

(73) Assignees: Pavel Sebor Family Trust, Heathrow, FL (US); Brian Phillipson Family Trust, Longwood, FL (US)

( * ) Notice: Subject to any disclaimer, the term of this patent is extended or adjusted under 35 U.S.C. 154(b) by 0 days.

(21) Appl. No.: 10/742,522

(22) Filed: Dec. 19, 2003

(65) Prior Publication Data

US 2004/0181884 A1 Sep. 23, 2004

Related U.S. Application Data

(62) Division of application No. 09/626,006, filed on Jul. 26, 2000, now Pat. No. 6,691,362.
(60) Provisional application No. 60/145,572, filed on Jul. 26, 1999.

(51) Int. Cl.[7] ..... E04H 4/16
(52) U.S. Cl. ..... 15/1.7; 15/246; 134/18; 134/21
(58) Field of Search ..... 15/1.7, 246, 404; 134/18, 21, 22.11

(56) References Cited

U.S. PATENT DOCUMENTS

| | | | |
|---|---|---|---|
| 3,439,368 | A | 4/1969 | Myers |
| 3,676,885 | A | 7/1972 | Wulc |
| 3,949,442 | A | 4/1976 | Chandler |
| 3,950,809 | A | 4/1976 | Schatzmann |
| 3,959,838 | A | 6/1976 | Hannah |
| 3,979,788 | A | 9/1976 | Strausak |
| 4,023,227 | A | 5/1977 | Chauvier |
| 4,084,535 | A | 4/1978 | Rees |
| 4,133,068 | A | 1/1979 | Hofmann |
| 4,168,557 | A | 9/1979 | Rasch, deceased et al. |
| 4,208,752 | A | 6/1980 | Hofmann |
| 4,351,077 | A | 9/1982 | Hofmann |
| 4,402,101 | A | 9/1983 | van Zyl |
| 4,429,429 | A | 2/1984 | Altschul |
| 4,434,519 | A | 3/1984 | Raubenheimer |
| 4,518,437 | A | 5/1985 | Sommer |
| 4,521,933 | A | 6/1985 | Raubenheimer |
| 4,536,908 | A | 8/1985 | Raubenheimer |
| 4,558,479 | A | 12/1985 | Greskovics et al. |
| 4,560,418 | A | 12/1985 | Raubenheimer |
| 4,589,986 | A | 5/1986 | Greskovics et al. |
| 4,656,683 | A | 4/1987 | Raubenheimer |
| 4,837,886 | A | 6/1989 | Rawlins |

(List continued on next page.)

FOREIGN PATENT DOCUMENTS

| | | |
|---|---|---|
| GB | 2005993 | 5/1979 |
| GB | 2153209 | 8/1985 |
| GB | 2181339 | 4/1987 |

*Primary Examiner*—Robert J. Warden, Sr.
*Assistant Examiner*—Shay Balsis
(74) *Attorney, Agent, or Firm*—Michael Best & Friedrich LLP

(57) ABSTRACT

A device is operably attached to a swimming pool cleaner for dislodging and permitting a steering of the swimming pool cleaner away from obstacles within a swimming pool. The device includes a coupling slidably attached to the swimming pool cleaner near its hose coupling. An upper, generally horizontally positioned, resilient elongate bumper has its opposing ends affixed to the coupling to form the upper bumper into an arcuate shape extending partially around a forward portion of the swimming pool cleaner. A second resilient, elongate vertical bumper has one end attached to the upper bumper and an opposing end attached a weight assembly of the pool cleaner at a location proximate the sealing flange. A roller is attached to the vertical bumper near the upper bumper for rotation thereabout when the swimming pool cleaner encounters an obstacle such as a step from which it is to be dislodged.

4 Claims, 4 Drawing Sheets

U.S. PATENT DOCUMENTS

| | | | | | |
|---|---|---|---|---|---|
| 4,920,599 | A | | 5/1990 | Rief | |
| 4,939,806 | A | | 7/1990 | Supra | |
| 5,014,382 | A | | 5/1991 | Kallenbach | |
| 5,033,148 | A | | 7/1991 | Chauvier et al. | |
| 5,077,853 | A | | 1/1992 | Campbell | |
| 5,097,559 | A | | 3/1992 | Brunt et al. | |
| 5,099,535 | A | | 3/1992 | Chauvier et al. | |
| 5,172,445 | A | | 12/1992 | Chandler | |
| 5,197,158 | A | | 3/1993 | Moini | |
| 5,226,205 | A | | 7/1993 | Pearce | |
| 5,245,723 | A | | 9/1993 | Sommer | |
| 5,259,082 | A | | 11/1993 | Sebor | |
| 5,274,868 | A | | 1/1994 | Sebor | |
| 5,303,444 | A | | 4/1994 | Sebor | |
| 5,317,777 | A | | 6/1994 | Stoltz | |
| 5,337,434 | A | | 8/1994 | Erlich | |
| 5,351,355 | A | | 10/1994 | Chiniara | |
| 5,404,607 | A | | 4/1995 | Sebor | |
| 5,412,826 | A | | 5/1995 | Raubenheimer | |
| 5,454,129 | A | | 10/1995 | Kell | |
| 5,896,610 | A | | 4/1999 | Sebor et al. | |
| 6,119,293 | A | * | 9/2000 | Phillipson et al. | 15/1.7 |
| 6,125,492 | A | * | 10/2000 | Prowse | 15/1.7 |

* cited by examiner

DEVICE AND METHOD OF ASSEMBLING A SUBMERSIBLE POOL CLEANER

CROSS-REFERENCE TO RELATED APPLICATIONS

This application is a Divisional of U.S. patent application Ser. No. 09/626,006 for "Device and Method for Dislodging a Submersible Pool Cleaner" having a filing date of Jul. 26, 2000 now U.S. Pat. No. 6,691,362 which claims priority to Provisional Application Ser. No. 60/145,572 for "Device and Method for Dislodging a Submersible Pool Cleaner" having a filing date of Jul. 26, 1999, and commonly owned with the instant invention.

FIELD OF THE INVENTION

The invention relates generally to swimming pool cleaners, and more particularly to the steering and dislodging of pool cleaners operable with a suction hose attached thereto.

BACKGROUND OF THE INVENTION

Typically, when the contour of a pool surface is such that a portion of the cleaner body is able to contact pool side walls while another portion of the cleaner is in contact with the pool bottom surface, the cleaner has a chance of becoming stuck against the pool surfaces. This is often the case for pool side walls which are generally perpendicular to the pool bottom surface, such as steps within a pool and square bottomed pools, as described by way of example in U.S. Pat. No. 3,803,658 to Raubenheimer, and No. 4,133,068 to Hofman. In such circumstances, the drag induced on the cleaner body will over-ride or may substantially impair the cleaner operation and its normal traversing along the pool surfaces, causing the pool cleaner to remain in one position or stay at that position for an inordinate amount of time.

As described in application Ser. No. 09/113,832 for "Submerged Surface Pool Cleaning device," whose disclosure is herein incorporated by reference, the ability of a swimming pool cleaner to move away from obstacles, such as a step, is assisted by employment of a bumper ring extending around the body portion of the cleaner. Further, a weight is attached near a base of a front wall portion of the body, which weight compliments the action of the buoyancy member for turning the cleaner when traveling along a vertical wall of a swimming pool.

SUMMARY OF THE INVENTION

In view of the foregoing background, it is an object of the invention to provide a device that is easily adapted to operate with a swimming pool cleaner for dislodging the pool cleaner from an obstacle within the pool. It is further an object to allow a swimming pool cleaner to effectively negotiate out of corners and discontinuities within a pool surface to be cleaned and satisfy a need well known in the pool cleaning art. The present invention provides an effective improvement to the pool cleaner by providing a reliable level of steering.

These and other objects, advantages, and features of the present invention are provided by a device operable with a swimming pool cleaner for dislodging and permitting a steering away from obstacles within a swimming pool, wherein the device comprises a coupling adapted for attaching to a swimming pool cleaner. A first resilient elongate bumper member having opposing end portions affixed to the coupling so as to form the first elongate member into an arcuate shape extending at least partially around a forward portion of the swimming pool cleaner operating therewith. A second resilient elongate bumper member has a first end preferably attached to a central portion of the first resilient elongate bumper member and a second opposing end for attaching to the pool cleaner at a location proximate a lower portion of the swimming pool cleaner near a sealing flange thereof. In one embodiment herein described, a roller is rotatably attached to the second resilient elongate bumper member for rotation about an axis generally vertical to the surface to be cleaned during a contacting of an obstacle from which the swimming pool cleaner is being dislodged. Alternatively, the roller or multiple rollers may be attached to the first and/or second resilient elongate bumper members.

BRIEF DESCRIPTION OF THE DRAWINGS

One embodiment of the invention is described, by way of example, with reference to the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiment set forth herein. Rather, this embodiment is provided so that this disclosure will be thorough and complete, and will fully convey the scope of the invention to those skilled in the art. Like numbers refer to like elements throughout.

Figure 1:
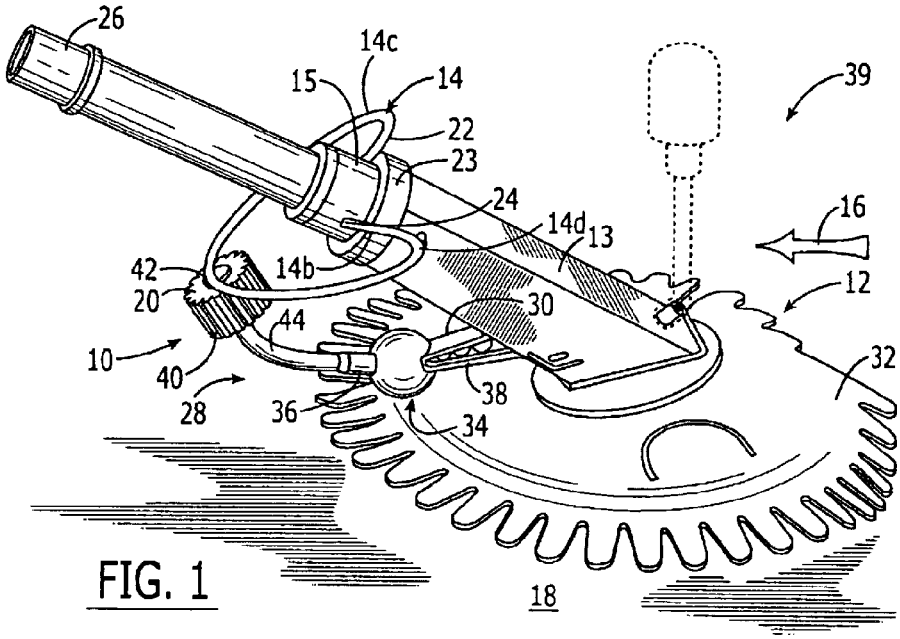
FIG. 1 is a top left side perspective view of one embodiment of the present invention operable with a vibratory styled swimming pool cleaner.
Figure 2:
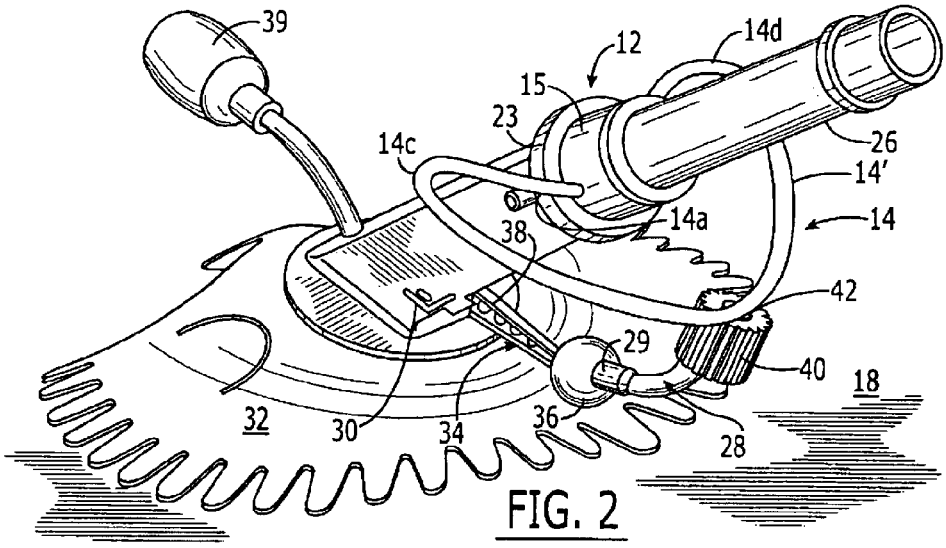
FIG. 2 is a top front right side perspective view of the embodiment of FIG. 1.
Figure 3:
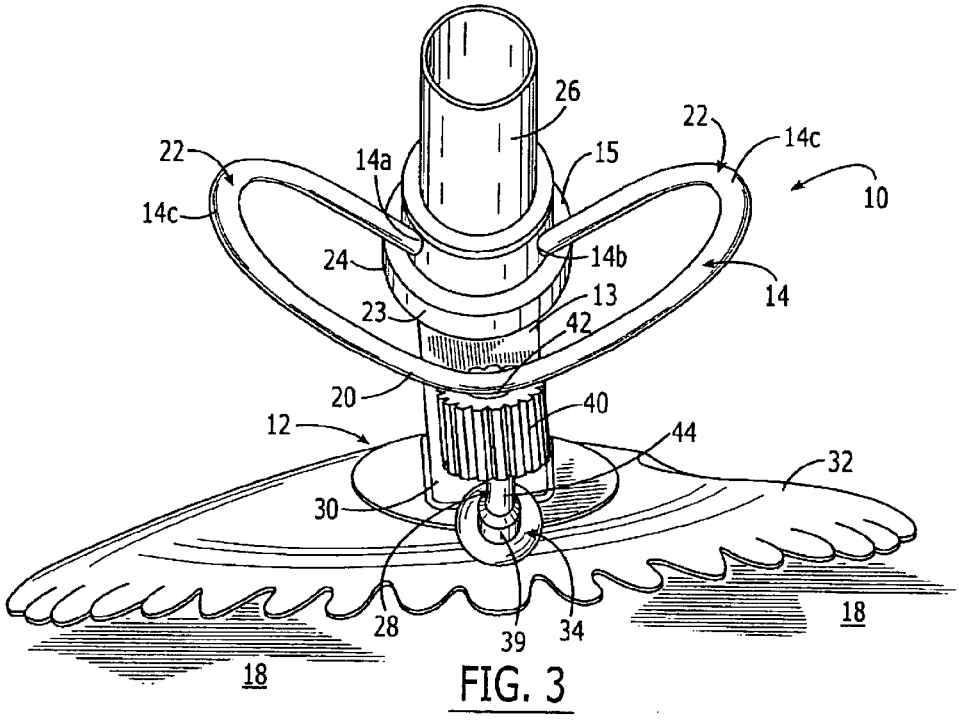
FIG. 3 is a front elevation view of the embodiment of FIG. 1.
Figure 4:
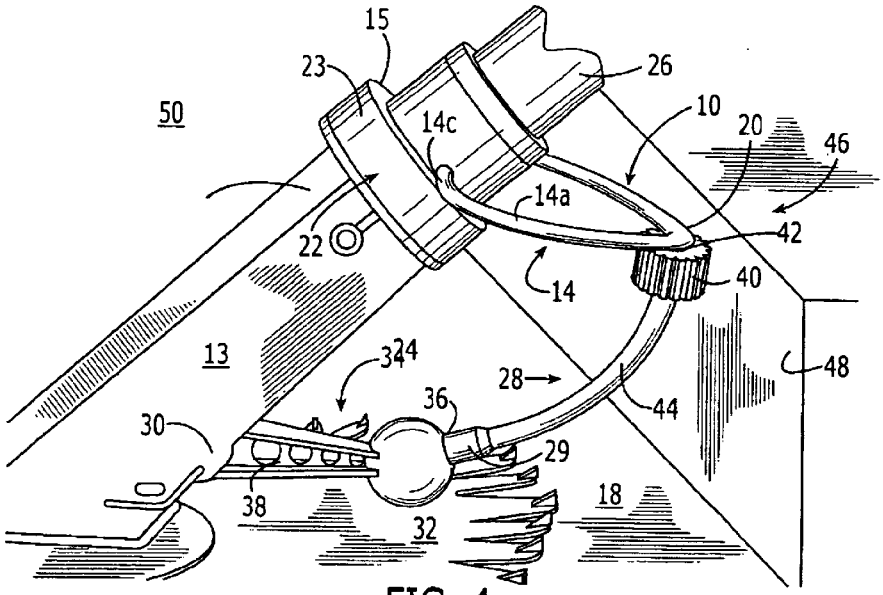
FIG. 4 is an enlarged partial right side perspective view of the embodiment of FIG. 1.

As illustrated initially with reference to FIGS. 1 and 2, the present invention, a device 10 for dislodging a submersible swimming pool cleaner 12 comprises an upper generally semicircular upper bumper member 14 that extends outwardly from an upper body portion 15 of the pool cleaner 12 generally in a direction of travel 16 and is oriented generally parallel along a surface to be cleaned 18. In one preferred embodiment of the present invention, a forward-most portion 20 of the upper bumper member 14 is closer to the surface to be cleaned 18 than a rear portion 22 of the upper bumper member. Ends 14*a*, 14*b* of the upper bumper member 14 are attached to a ring 23 which is attached for rotation within a cleaner housing flanged portion 24. The ring 23 is attached to a cleaner housing portion 24 proximate a hose coupling 26 for the cleaner 12, wherein such portion is generally circular in cross-section. However, it is to be understood that alternate cleaner housing shapes may be appropriate for fixed and for such slidable or rotatable attachment. The generally semicircular shape includes lobe portions 14*c*, 14*d* that form a rear portion 22 of the bumper member 14, as further illustrated with reference to FIG. 3.

Figure 5:
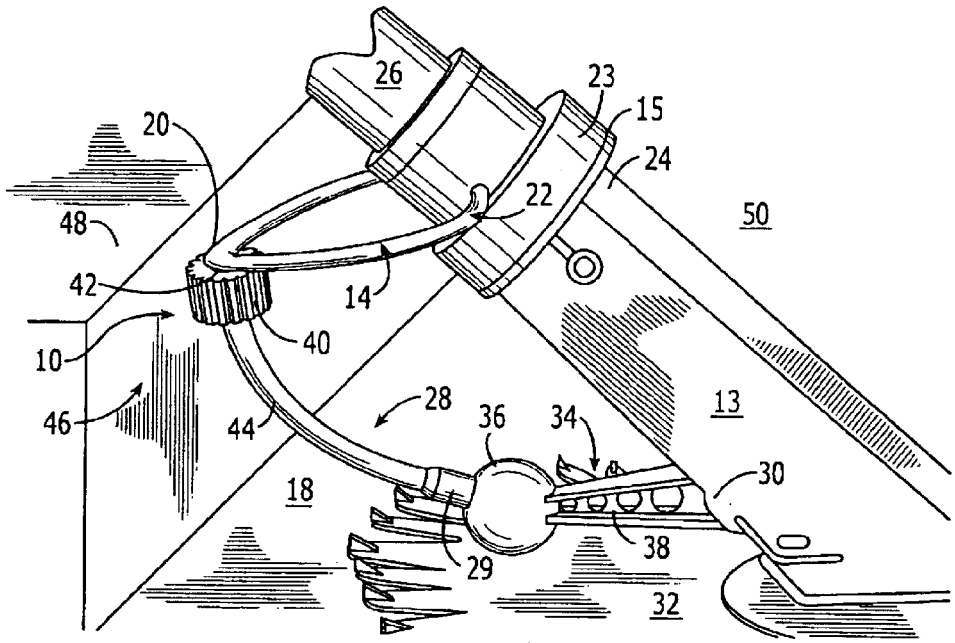
FIG. 5 is an enlarged partial left side perspective view of the embodiment of FIG. 1.
Figure 6:
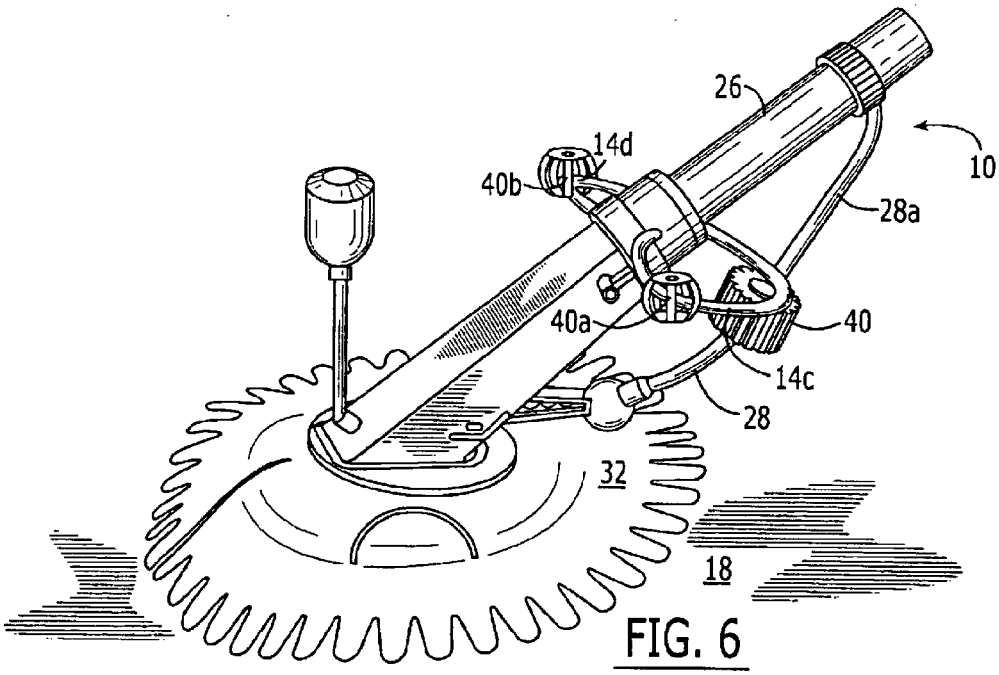
FIG. 6 is a perspective view of an embodiment of the present inventio illustrating an alternate bumper member, and alternate arrangements of rollers on an upper bumper member.

As illustrated with reference again to FIGS. 1–3, and with reference to FIGS. 5 and 6, the forward portion 20 of the upper bumper member 14 is connected to a lower bumper member 28 oriented generally perpendicular to the surface to be cleaned 18. A lower extremity 29 of this lower bumper member 28 is attached to the swimming pool cleaner 12 at a housing lower portion 30 proximate a sealing flange 32 typically attached at the lower housing portion 30. In the swimming pool cleaner 12, herein described by way of example, a ballast assembly 34 extends from the housing lower portion 30. For this embodiment, one preferred embodiment includes the lower bumper member 28 attached to a distal end 36 of the ballast assembly including a weight extension arm 38. As is known in the art, the ballast assembly 34 is operable with a float assembly 39 during operation of the cleaner 12. One embodiment of the present invention includes one or both bumper members 14, 28 manufactured from flexible resilient material.

Figure 7:
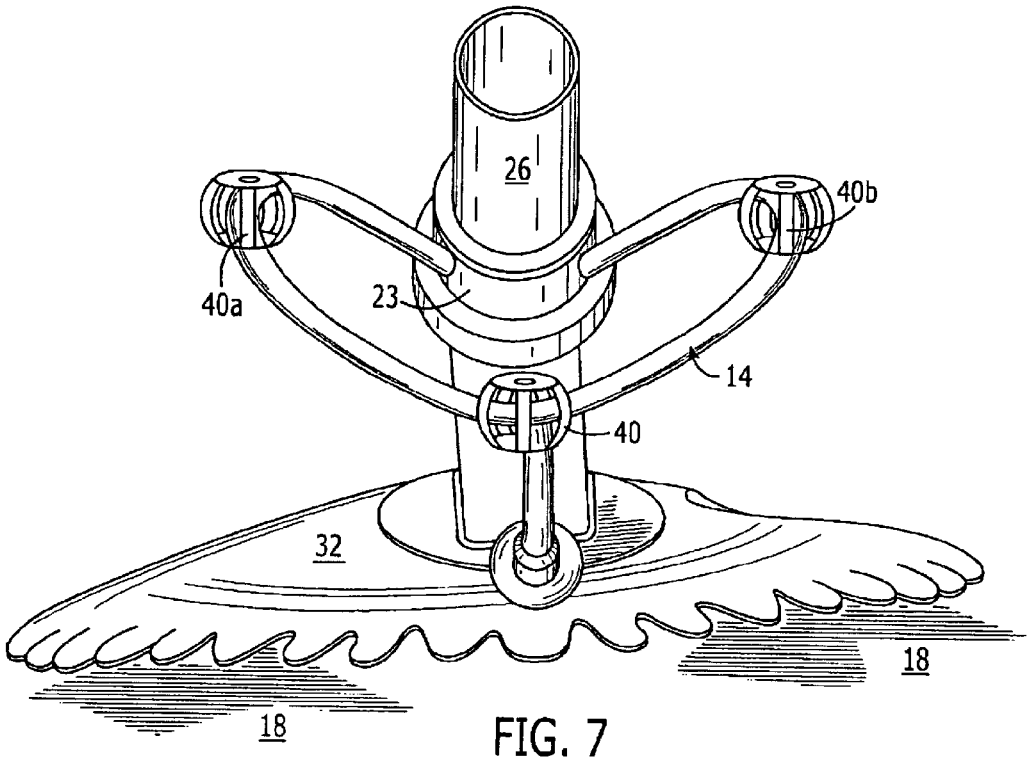
FIG. 7 is a front perspective partial view of an alternate embodiment of the present invention.

As illustrated again with reference again to FIGS. 1–5, one preferred embodiment, as herein described, includes a roller 40 which is rotatably carried proximate a connection 42 of the upper and lower bumper members 14, 28. The roller 40 rotates about a shaft portion 44 of the lower bumper member 28, which shaft portion is integrally formed with the lower bumper member. As illustrated with reference to FIG. 6, rollers 40*a*, 40*b*, 40*c* are alternatively carried by the upper bumper member, and preferably at the lobes 14*c*, 14*d*. Further, the rollers 40 may be attached to both the upper and lower bumper members 14, 28 in yet other embodiments as dictated by the conditions and user. As illustrated with reference to FIG. 7, alternate embodiments may include rollers 40, 40*a*, 40*b* on the upper bumper member, wherein an alternate device configuration operates without the lower bumper member 28. As illustrated with reference again to FIG. 6, the lower bumper member 28 is extended 28*a* above the upper bumper member 14, which extension 28*a* extends from the upper bumper member 14 to an end portion of the hose coupling 26. Such an extension 28*b* has been shown to be effective in aiding the cleaner 12 when seeking to dislodge itself form obstacles such as a ladder, typically found with a swimming pool environment.

By way of example, in operation and illustrated again with reference to FIGS. 4 and 5, when the pool cleaner 12 approaches an obstacle 46 such as a step 48 of a swimming pool 50, the device 10 will engage the step 48 and hold the body 13 of the cleaner 12 away from the obstacle 46 while the cleaner 12 maneuvers free of the obstacle under its motive power. The flexibility of the device 10 and its slidable movement about the flanged housing portion 24, while attached to the ballast assembly 34, provides a thrusting away from the obstacle for aiding the cleaner 12 in dislodging the cleaner during its vibratory movement. The inclined orientation of the upper bumper member 14 serves to enhance the thrusting effect provided by the device. For such a typical situation, the first portion of the device 10 to engage the obstacle 46 will generally be the lower bumper member 20 or the roller 40. Upon such engagement, the momentum of the cleaner 12 and/or the jerking action of the cleaner itself will cause the direction of travel 16 to change to the left or right. The ability of the roller 40 to rotate reduces the effect of friction and further enhances the dislodging effect of the device 10.

Once deflected, the cleaner 12 will typically move in a direction parallel to the leading edge of the obstacle 46. Portions of the upper bumper member 14 will then engage the obstacle 46 and hold the body 13 of the cleaner 12 away from the obstacle. Should a portion of the obstacle 46 fit just below the upper portion of the upper bumper member 14, as more of the obstacle 46 extends below and in contact with the member, the downward inclination of the upper bumper member 14 will cause a lifting force to be applied to the body 13 of the cleaner 12. This will have the effect of breaking or weakening the cleaner's suction/adherence to the surface to be cleaned 18, thus making it easier for the cleaner 12 to maneuver away from the obstacle 46.

The resilience of the bumper members 14, 28 as earlier described, reduces possible damage to the obstacle 46 and the device 10 caused by rubbing of the bumper members 14, 28 against the obstacle. As above described, resilience of the device 10 provides a springiness to the bumper members 14, 28 which improves the ability of the cleaner 12 to maneuver away from the obstacles 46. The resilience of the bumper members 14, 28 of the device 10 is also a safety feature permitting deflection of the cleaner on contact with a foot or body portion of a swimmer.

Many modification and other embodiments of the invention will come to the mind of one skilled in the art having the benefit of the teachings presented in the foregoing description and associated drawings. Therefore, it s to be understood that the invention is not to be limited to the specific embodiment disclosed, and that modifications and embodiments are intended to be included within the scope of the appended claims.

That which is claimed is:

1. A method of assembling a swimming pool cleaner useful for dislodging the cleaner from an obstacle, wherein the swimming pool cleaner includes a housing having a flow control valve carried therein for providing a vibratory movement, which vibratory movement results in a movement of the swimming pool cleaner in a direction of travel, and a flexible flange member attached to a lower housing portion for engaging a surface to be cleaned, the method comprising:

attaching a coupling to an upper housing portion;

attaching a first resilient elongate bumper member having opposing end portions affixed to the coupling so as to form the first elongate member into an arcuate shape for extending at least partially around a forward portion of the housing, and providing a second resilient elongate bumper member, attaching a first end of the second resilient elongate bumper member to a central portion of the first resilient elongate bumper member; and attaching a second, opposing end of the second resilient member to a lower housing portion of the housing.

2. The method according to claim 1, further comprising rotatably attaching a roller to the second resilient elongate bumper member for rotation thereabout, the roller operable proximate the first resilient elongate bumper member.

3. The method according to claim 1, wherein the housing comprises a flanged circular portion formed within the housing upper portion, and wherein the coupling attaching comprises carrying a ring within the flanged circular portion.

4. The method according to claim 1, wherein the arcuate shape of the first elongate bumper member comprises opposing left and right lobe portions extending along side portions of the swimming pool cleaner.

* * * * *